US005141057A

United States Patent [19]

Chaix

[11] Patent Number: 5,141,057

[45] Date of Patent: Aug. 25, 1992

[54] SAFETY SLEEVE FOR A BOREHOLE COMMUNICATING WITH AN UNDERGROUND RESERVE OF FLUID UNDER PRESSURE, AND ASSOCIATED SAFETY SYSTEM, AND AN ASSOCIATED BOREHOLE OPERATING METHOD

[75] Inventor: Jean Chaix, Vaucresson, France

[73] Assignee: Societe Francaise de Stockage Geologique-Geostock, Rueil-Malmaison Cedex, France

[21] Appl. No.: 698,209

[22] Filed: May 10, 1991

[30] Foreign Application Priority Data

May 11, 1990 [FR] France ..... 90 05931
Jan. 4, 1991 [FR] France ..... 91 00059

[51] Int. Cl.[5] ..... E21B 34/06

[52] U.S. Cl. ..... 166/373; 166/316; 405/58

[58] Field of Search ..... 166/373, 51, 321, 65.1, 166/316

[56] References Cited

U.S. PATENT DOCUMENTS

| | | | |
|---|---|---|---|
| Re. 28,588 | 10/1975 | Sizer . | |
| 2,994,200 | 8/1961 | Carpenter . | |
| 3,008,522 | 11/1961 | Fredd et al. . | |
| 3,277,644 | 10/1966 | Shiver . | |
| 3,313,350 | 4/1967 | Page, Jr. . | |
| 3,850,246 | 11/1974 | Despujols | 166/51 X |
| 3,999,608 | 12/1976 | Smith | 166/51 X |
| 4,312,415 | 1/1982 | Franks, Jr. . | |
| 4,401,158 | 8/1983 | Spencer et al. | 166/51 |
| 4,423,782 | 1/1984 | Bowyer . | |
| 4,570,714 | 2/1986 | Turner et al. | 166/51 X |
| 4,603,742 | 8/1986 | Wong et al. | 166/373 X |
| 4,635,725 | 1/1987 | Burroughs | 166/51 X |
| 4,683,944 | 8/1987 | Curlett | 166/65.1 |

*Primary Examiner*—Ramon S. Britts
*Assistant Examiner*—Frank S. Tsay
*Attorney, Agent, or Firm*—Sughrue, Mion, Zinn, Macpeak and Seas

[57] ABSTRACT

In order to provide safety in a borehole communicating in particular with a cavity washed out from rock salt and containing gas under pressure, the prior art provides devices suffering from the drawback of reducing the flow sections through the tubes in the borehole. The present invention minimizes this section reduction by means of a hollow cylindrical sleeve closed inside by a plug and including ducts formed in its wall in such a manner as to cross over the flows of fluid taking place respectively in a central tube of the borehole and in the annular space between the central tube and a peripheral tube. In one embodiment of the present invention, the sleeve is sandwiched between portions of the central tube and of the peripheral tube, with safety valves advantageously being mounted on the portions of central tube above and below the sleeve. This provides a safety system suitable for implementing the method of the invention by being connected in line with the central tube and the peripheral tube of the borehole. As a result, both the flow established in the central tube and the flow established in the annular space can be stopped in the event of an accident by the valves without the valves significantly reducing the normal flow section of the central tube. When exploiting a well in "dual completion" mode, this structure also provides significantly larger flow sections than provided by prior art tube systems.

30 Claims, 7 Drawing Sheets

SAFETY SLEEVE FOR A BOREHOLE COMMUNICATING WITH AN UNDERGROUND RESERVE OF FLUID UNDER PRESSURE, AND ASSOCIATED SAFETY SYSTEM, AND AN ASSOCIATED BOREHOLE OPERATING METHOD

The present invention relates to systems of tubes which are disposed in boreholes in particular for exploiting underground reserves of fluid under pressure, which reserves may be natural (oil-bearing deposits) or artificial (storage cavities in suitably impermeable rock). In particular, the invention provides a safety device making it easier to close off any passage between said tubes and the outside of the borehole. Because of its structure, this device is generally referred to below as a "sleeve". The invention also extends to a safety system comprising the sleeve together with a length of tube and safety valves of conventional type. It makes it possible to implement a method of operating the borehole in which it is disposed that is particularly advantageous from the points of view of economy, reliability, and safety.

BACKGROUND OF THE INVENTION

To provide a better understanding of the technical aspects of the safety problem of boreholes communicating with underground reserves of fluid, reference is initially made to a relatively detailed example illustrated in the first four accompanying figures. These figures apply to a particular case of a storage facility using a cavity excavated by washing out rock salt. As shown in FIG. 1 which includes vertical graduations to give an idea of scale, cavities of this type may have volumes of up to about $5\times10^5$ m$^3$. A single borehole 2 connects the cavity 1 to the surface when operating units 3 are installed. To do this, the borehole often passes through salt 6, but also and mainly it passes through overlying sedimentary rock 5. The washing out technique for forming the cavity 1 consists essentially in injecting fresh water via a dip tube 10 and in recovering the water saturated with dissolved salt (known as brine) through the annular gap between the tube 10 and a temporary guard tube (not shown) installed in the borehole 2. This technique also gives rise to an accumulation of insoluble material 7 at the bottom of the cavity 1, and the cavity remains filled with brine.

Before being able to store gas therein, for example, the site operator must therefore remove the initial brine. This takes place in a stage prior to operation per se, and referred to in the art as "dewatering". This is shown diagrammatically in FIG. 2 in which fairly realistic relative dimensions are retained by means of two imaginary nearly horizontal section lines. This shows up more clearly the structure of the borehole 2 and the configuration of the tubes it contains specifically during this stage. Starting from the center, there is the dip tube 10 which extends down nearly to the bottom of the cavity, with its bottom end opening out immediately above the insoluble materials 7. It is referred to below as the "central" tube. It is surrounded by a casing system for the borehole 2 and delimiting an annular space 9. Still going towards the outside of the borehole, this system comprises: a protective tube 30 (also referred to below as a "peripheral" tube), metal casing 20, and a cement lining 25. The lining extends down to the shoe 21 at the bottom of the borehole 2 and ensures that the casing is firmly attached to the rock, and a brine-based liquid of appropriate density, often referred to as "completion liquid" in the art, is disposed between the protective tube 30 and the casing 20. This liquid is retained at the bottom by an annular packer 31 and serves to exert a supporting force on the casing 20 thus making it possible to reduce its crushing strength.

Dewatering then consists in injecting the gas G to be stored via the annular space 9. So long as its pressure is high enough, it pushes the gas/brine interface 8 downwards the bottom of the cavity, with the brine B thus being constrained to rise via the dip tube 10. In this way, the brine B within the cavity is replaced progressively by the gas G. When the cavity finally contains gas only, storage operation proper may begin. This generally lasts for 20 to 25 years, during which time gas is drawn off or replaced at widely spaced-apart intervals. For these operations it is usual for all or a part of the dip tube 10 extending inside the cavity to be removed. That is why this tube is referred to below as the central tube, i.e. with reference to its central position in the borehole. It is conventional for the gas that is taken away at the surface to be drawn off via this tube, and for the annular space 9 to be voluntarily closed off.

This method of operation can be explained by the need to provide a borehole in operation with safety devices that are suitable, in the event of an accident, for interrupting all communication between the cavity 1 under pressure and the surface. The normally-closed safety valves that are usually used for this purpose happen to be easier to fit to the central tube 10 and to be unsuitable for placing the annular space 9 without additional fittings. It is therefore common practice for operators to take the precaution of closing off this annular space as soon as dewatering has been accomplished. Various ways have been used in the past for doing this. One of them, commonly implemented at present, is shown in FIGS. 3 and 4 which are half-sections of the borehole. An annular mask 40 is attached to the inside of the central tube 10. The mask 40 has a telescopic portion 42 which is deployed to its maximum length (FIG. 3) or is fully retracted (FIG. 4) depending on whether oil under pressure is applied to a control line 44. When extended, the mask 40 isolates the inside of the central tube 10 from the annular space 9. Instead, the lateral orifices 11 and 12 formed through the central tube 10 are put into communication with each other so that the gas injected during dewatering, for example, can bypass a fixed connection provided between the central tube 10 and the protective tube 30. When the mask is retracted, one of the lateral orifices 11 is disengaged while the other lateral orifice 12 remains isolated by the mask. In these circumstances, the gas drawn off is diverted from the annular space 9 into the central tube 10.

Although this device does indeed contribute to providing safety for the storage facility while in operation by closing off the annular space 9, it nevertheless from several drawbacks. Firstly, prior systems inherently reduce the flow section available to gas being drawn off, since the total flow section of the central tube plus the annular space is restricted at the outlet to the section of the central tube only. In other words, above the safety valve, only a portion of the inside section of the borehole 2 is used, thereby increasing head losses in the corresponding gas flow and also increasing its flow velocity. In addition, these head losses are further increased by items comparable to the above-described mask 40 since they take up room inside the central tube and reduce its flow section. They also contribute to hindering insertion of downhole tools or withdrawal of tubes. Other ways of closing the annular space during the operating stage have also been designed that are not inserted in the central tube, and therefore do not restrict its section. However these other items suffer from other drawbacks such as the need to offset the central tube relative to the axis of the borehole, the need to provide compact safety valves so that they can be disposed directly in the annular space, the risk of the casing suddenly becoming detached under the effect of internal pressure, the risk of being impossible to remove, . . .

An object of the present invention is thus to optimize both dewatering and operation proper of the borehole, while nevertheless making it easy to use conventional means such as normally-closed valves of regular size for safety purposes during operation. This object is achieved without the above-listed drawbacks occurring.

SUMMARY OF THE INVENTION

To do this, the present invention provides a safety sleeve for a borehole communicating in particular with a underground reserve of fluid under pressure, a peripheral tube being disposed in said borehole together with a central tube coaxial with said peripheral tube, thereby defining an annular space between them, wherein the sleeve is constituted by a hollow cylinder having a top end and a bottom end and an inside surface and an outside surface, said sleeve being adapted to be connected level with said outside surface to said peripheral tube and level with said inside surface to said central tube, an annular groove being formed in said inside surface to receive a plug, and ducts being provided to put said annular space into communication with said central tube, a first series of said ducts running from said top end of said cylinder and terminating in said inside surface between said groove and said bottom end of said cylinder, while a second series of said ducts runs from said bottom end of said cylinder and terminates in said inside surface between said groove and said top end of said cylinder.

For example, said cylinder may be a thick-walled cylinder and each of said ducts may include a portion extending longitudinally in said thick wall of said cylinder and extended by a bend and an oblique portion. In a first advantageous embodiment, each of said ducts is locally cylindrical in section, said ducts being preferably circumferentially distributed at uniform spacing. For example, there may then be eight ducts in all, each of said series of ducts comprising four ducts that are immediately adjacent to one another. In a second advantageous embodiment each of said series of ducts is constituted by the geometrical envelope of parallel cylindrical channels disposed in such a manner that pairs of adjacent channels interpenetrate.

Advantageously, said cylinder constituting said sleeve is machined in a billet of steel. Alternatively it may be forged. Its height preferably lies in the range about 1.5 meters (m) to about 3 m.

The present sleeve then constitutes a portion of a safety system which, according to the invention, also includes a length of central tube constituted by a top portion connected to said top end of said sleeve and by a bottom portion connected to said bottom end of said sleeve, at least said bottom portion being provided with a safety valve suitable for closing said central tube in the event of an accident.

Advantageously, said length of central tube is of the order of 10 meters long. A plug seat is preferably provided in each of said portions of said length of central tube in the immediate proximity of said sleeve.

If said top portion of said length of central tube is terminated in a flare, said bottom portion of said length of central tube is advantageously terminated by an inside annular groove, with another plug seat being disposed between said safety valve and said groove.

Advantageously, said safety valve is of the normally-closed removable type. It may be installed around said length of central tube and include a control line for conveying a hydraulic fluid, which line is held in place by virtue of being received in part within said sleeve.

In one embodiment of the safety system, the outside surface of said sleeve is provided with ring seals for providing sealing between said sleeve and the peripheral tube.

In another embodiment, the safety system instead includes a length of peripheral tube which is substantially as long a s said length of central tube and which is similarly constituted by a top portion connected to said top end of said sleeve and by a bottom portion connected to said bottom end of said sleeve. When said peripheral tube is a protective tube installed within cemented casing, said top portion of sad length of peripheral tube includes an orifice for passing said control line, means being provided to seal said orifice.

The present invention also provides a method of operating a borehole in communication in particular with an underground reserve of fluid under pressure, a peripheral tube being disposed in said borehole together with a central tube coaxial with said peripheral tube such that an annular space is defined between then, the method implementing a safety system such that flows established respectively in the central tube and in the annular space are interchanged.

In a first implementation, a first operation of said method consists in connecting said safety system to said central and peripheral tubes, said top portion of said length of the central tube being likewise provided with a further safety valve suitable for closing said central tube in the event of an accident.

When said underground reserve is constituted by a cavity washed out in rock salt and initially filled with brine, and when said fluid in the reserve is a gas, an intermediate operation of said method consists in filling said cavity with said gas, said gas being injected under pressure via said central tube above said sleeve, and then passing through said annular space beneath said sleeve, thereby pushing said brine which rises via said central tube beneath said sleeve and is recovered from said annular space above said sleeve.

In the same implementation, a final operation of said method consists in removing said fluid in the reserve to the surface and/or injecting said fluid into said underground reserve via both said central tube and said annular space.

When said reserve comprises an upper hydrocarbon producing layer and a lower hydrocarbon producing layer, with a production well passing through both productive layers and enabling hydrocarbons to penetrate into the well from the two layers:

a) the first operation of the present above-specified method further consists in placing in the well:

the peripheral tube in such a manner that a bottom end thereof lies above the upper producing layer, a first annular packer being disposed around the bottom end of the peripheral tube to block the space between the peripheral tube and the wall of the borehole; and the central tube inside the peripheral tube in such a manner that a bottom end of the central tube lies between the upper producing layer and the lower producing layer, a second annular packer being disposed around the bottom end of the central tube to block the space between the central tube and the wall of the borehole; whereas b) during subsequent "dual completion" production, the following flows are established:

at the bottom of the borehole, a flow of hydrocarbons from the lower producing layer in the central tube, and a flow of hydrocarbons from the upper producing layer in the annular space;

at the top of the borehole, the flow of hydrocarbons from the upper producing layer in the central tube, and the flow of hydrocarbons from the lower producing layer in the annular space;

the hydrocarbon flows from the two layers intersecting in the sleeve.

It may be observed that all the equipment installed during the first operation is extremely simple. It is then advisable to check that the space between the peripheral tube and the wall of the borehole is selected to be as narrow as possible compatible with the operations of installing the peripheral tube and that the safety valves have bodies installed around the central tube to which they are attached. Maximum flow passages are thus obtained for separately raising two kinds of hydrocarbon.

It may also be observed that the wall of the borehole may be lined with casing provided with perforations overlying the layers producing hydrocarbons and/or that a support liquid retained by the first annular packer may be disposed between the casing and the peripheral tube.

In another implementation of the present method, a first operation of said method consists in connecting said safety system to said central peripheral tubes with a liner being applied in sealed manner against the inside surface of said sleeve in such a manner as to close said ducts, said plug being removed, with a subsequent operation of said method consisting in drawing off said fluid from the underground reserve and/or in injecting fluid into said reserve via said central tube only.

Advantageously, during the operation of connecting said safety system, said system is disposed at 30 meters beneath the surface of the ground, or even deeper if that should be judged necessary. However, given that said borehole also includes cemented casing terminated at the bottom by a shoe, and that said peripheral tube is constituted by a protective tube installed in said cemented casing, said safety system may alternatively be disposed at about 10 meters above said shoe of said borehole during the operation of connecting said safety system.

Still during the operation of connecting said safety system, top lengths of the central tube are provided with sealing rings and engaged within said top portion of said length of central tube of said safety system, whereas bottom lengths of the central tube are attached within said bottom portion of the length of the central tube of said safety system via anchor pieces and an inflatable chamber such that said top and bottom lengths may be withdrawn at any time without it being necessary to dismantle said connection to said safety system.

In other words, as soon as the present sleeve is disposed within the system of tubes in the borehole, with its central plug being installed and with its ducts being disengaged, it diverts the annular fluid flow towards the central tube and the central tube fluid flow towards the annular space, with the two corresponding flows thus being caused to cross or intersect each other. This has the advantage that both flows pass along the central tube at some stage. Because of the two safety valves mounted in the tube, one installed below the sleeve and the other above it, it is guaranteed that the entire flow section between the underground reserve and the surface can be closed off, if so required.

This result is obtained without accepting the drawbacks of the prior art. The flows are not subjected to excessive head loss on going through the sleeve since its ducts may be made relatively large (and in any case larger than the lateral orifices 11 and 12 of the above-described prior art device). Similarly, the flow speeds are move favorable. It may be observed that the central tube and the peripheral tube remain concentric. In addition, by making it possible to place the safety valves on the central tube only, it is possible to make use of regular type valves, so there is no need for valves that are particularly compact. Finally, there is nothing restricting the flow passage inside the central tube. Any tool that may be required can be lowered down the central tube through a substantially full cross-section merely by removing the plug installed in its seat.

Other advantages need mentioning depending on the nature of the fluid reserve. If this reserve is a cavity washed out from rock salt, then the present sleeve is preferably installed even for the dewatering stage. In operation, after dewatering it enables fluid to be drawn off and recovered from the reserve both via the central tube and via the annular space. In other words, the fluid flow section to the outlet is increased over the prior art by the section of the annular space. This is practically equivalent to doubling the section and further contributes to reducing head losses and to improving flow velocities for a given flow rate.

However, the present safety system is equally applicable to oil-bearing deposits and is suitable both for an injection borehole and for an extraction well, i.e. a well for drawing off oil. In this case it is particularly applicable to "dual completion" type operation.

In the oil production industry, the term "dual completion" is commonly used with respect to deposits including two geological layers containing hydrocarbons that are separated by at least one impermeable layer. Regardless of whether the hydrocarbons are then gaseous, liquid, or a mixture of oil and gas, the "dual completion" technique seeks to recover them on the surface without the fluids from the two layers coming into contact with each other.

The method used in the past consists in using a production well passing through both layers. Its casing is thus pierced with perforations overlying both producing layers. In addition, two production tubes communicate with the surface, each of which is provided with its own safety valve, which tubes lie side by side inside the borehole. The first tube may be the shorter tube and terminate level with the upper perforations. The second tube extends down to the lower perforation and advantageously has a slight bend in order to take up a more central position inside the casing as soon as it has gone past the bottom end of the first tube. The system is then finished off by two packers disposed between the casing and the tubes so as to constrain the hydrocarbons to flow inside the tubes. One of these packers is located substantially at the depth of the intermediate impermeable layer. It is simple in shape since it serves to close of the annular space between the second tube and the casing. In contrast, the other packer is more complex in shape since it lies above the upper producing layer so it is required to provide isolation while allowing two tubes to pass through it.

This is one of the major drawbacks of the conventional "dual completion" operating method. The corresponding packer referred to in the art as a dual packer is relatively sophisticated in design. As a result, in addition to its considerably higher cost than a simple annular packer, it is more difficult to implement. Other drawbacks are more directly related to the tubes. In particular it is always difficult to install them side by side. It will also be understood that the flow section provided in this way for the fluids from the two producing layers remains relatively small compared with the total available section inside the casing. The present method avoids the drawbacks of the prior art as emphasized above.

Finally, the present safety system can be remarkably effective from the safety point of view. Operators can choose to install it close to the bottom of the borehole, i.e. at a location which is of reduced vulnerability both with respect to natural geological events and with respect to possible sabotage. It is also possible for operators to dismount all or part of the safety system and raise items to the surface that need to be inspected or repaired. Naturally, these advantages are in addition to the significant increase in flow section at the outlet from the borehole. For a borehole used in exploiting a deposit, this opens the possibility of reducing the number of boreholes needed, thereby greatly reducing financial costs.

Finally, by applying a liner inside the sleeve to close its ducts while its plug is removed, the system of tubes can be returned to a situation analogous to that of the prior art during an operation stage. However, the advantage of having a safety valve mounted on the central tube instead of inside it remains, thereby releasing the full section of the central tube to fluid flow. This aspect may also be combined with an annular space that is particularly small whenever other flow considerations make that possible. Under such circumstances, the present sleeve merely serves to close off the annular space. Nevertheless, it is particularly effective in this role since it constitutes an integral portion of the tubes in the borehole and therefore cannot become detached therefrom.

BRIEF DESCRIPTION OF THE DRAWINGS

The present invention will be better understood on reading the following detailed description and on examining the accompanying drawings which show various embodiments of the present sleeve and of the present safety system including it by way of non-limiting example. The figures also illustrate ways of implementing the present method of operating a borehole in communication with an underground reserve of fluid.

In the drawings.

DETAILED DESCRIPTION

Figure 5:
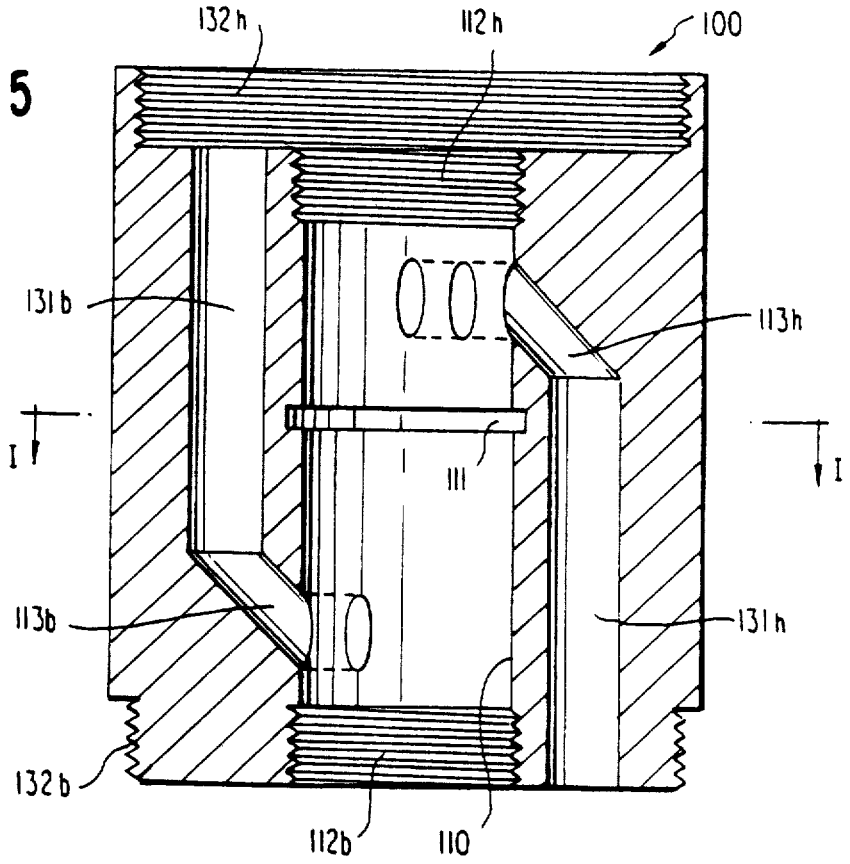
FIGS. 5 and 6 show a safety sleeve in accordance with the present invention, the sleeve being shown in axial section in FIG. 5 and in cross-section in FIG. 6 on plane I—I of FIG. 5.
Figure 6:
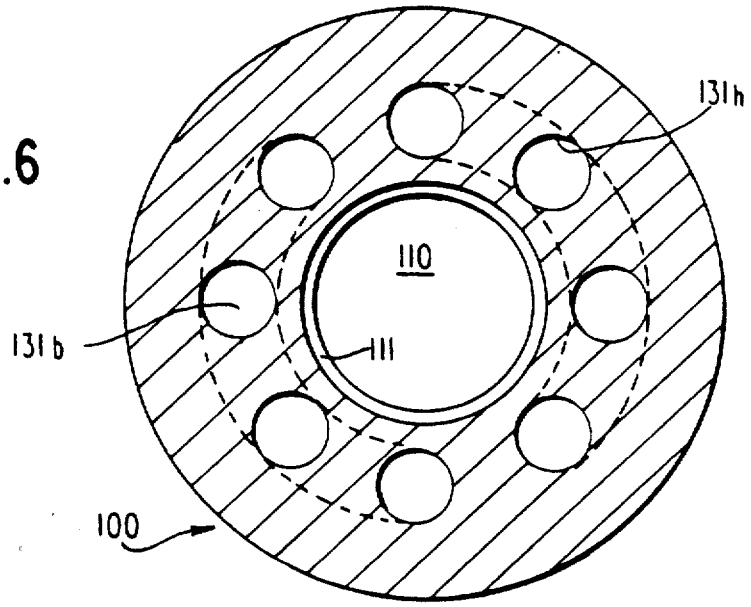

FIGS. 5 and 6 show a safety sleeve 100 of the invention. It is constituted by a thick-walled cylinder that may be 1.5 m to 3 m high, e.g. machined in a billet of steel or else forged. The outside diameter of the sleeve is substantially the same as the outside diameter of the protective tube 30 (peripheral tube) which is to receive it down the borehole. For example, threads 132 may be provided for connecting the sleeve to the tube. In the axial section of FIG. 5, it can be seen that a bottom thread **132*b* may be directly provided on the outside surface of the sleeve, while a top thread 132*h* may be formed inside a rim projecting axially from the sleeve. Similarly, the inside diameter of the sleeve is selected so that the central tube 10 can be connected in sealed manner to the bore 110 of the sleeve. For example, bottom and top threads 112*b* and 112*h* may be formed for this purpose in the surface of the bore 110 in the vicinity of each of the ends of the sleeve 100**.

In addition to the features described above and which so far merely indicate that the sleeve constitutes a connection part for interconnecting two lengths of protective tube 30 and also for interconnecting two lengths of central tube 10, the sleeve has additional characteristics conferring bypass qualities thereto enabling two fluid flows to cross each other. Firstly there is a groove 111 provided in the surface of the bore 110 of the sleeve 100 about halfway therealong. This groove 111 is adapted to serve as a seat for a plug 60 shown in FIG. 7 for the purpose of closing the bore 110 in fluidtight manner. As a result, the passage offered by the central tube 10 is interrupted at the sleeve 100 and the advantages of this feature are described in the following paragraph. In addition, ducts 131 are pierced within the thickness of the wall of the cylindrical sleeve 100. Each of these ducts comprises a longitudinal portion running from the transverse surface of the sleeve wall i.e. from one or the other of its ends. In other words, these duct portions are designed to be in communication with the annular space 9 once the sleeve 100 has been mounted between respective lengths of the protective tube 30 and of the central tube 10. The longitudinal portions are extended by bends and respective sloping portions 113 which open out finally into the bore 110 in the sleeve. Once the sleeve 100 is connected to the tubes, the ducts 131 are in communication with the central tube 10. They therefore connect the annular space 9 to the inside of the tube 10.

The rectilinear longitudinal portions of the ducts may be cylindrical and circumferentially spaced apart at equal distances from one another as shown by solid lines in the axial and transverse sections of FIG. 5 and 6 respectively. The number of such portions can be adapted to the diameter of the various ducts, tot he wall thickness of the sleeve, to the desired flow rates, etc. . . . FIGS. 5 and 6 show eight such portions, however there could equally borehole be four or even fewer. Alternatively they could be so numerous as to interpenetrate and constitute common passage together. This is represented in FIGS. 5 and 6 by dashed lines. However there is no question of interconnecting all of the ducts. There must be a first series of ducts (half of them in the figures) opening out above the plug seat 110 (cf. sections **131*h* and 113*h*) and a second series constituted by the remaining ducts which open out beneath the seat 111 (cf. sections 131*b* and 113*b*). In the cross-section of FIG. 6, all of the ducts 131*h* of the first series are drawn side-by-side. They are thus all formed in the same half of the sleeve (assuming that the entire cylinder is cut in two on a diameter). The ducts 131*b*** in the second series are formed in the other half sleeve.

Figure 7:
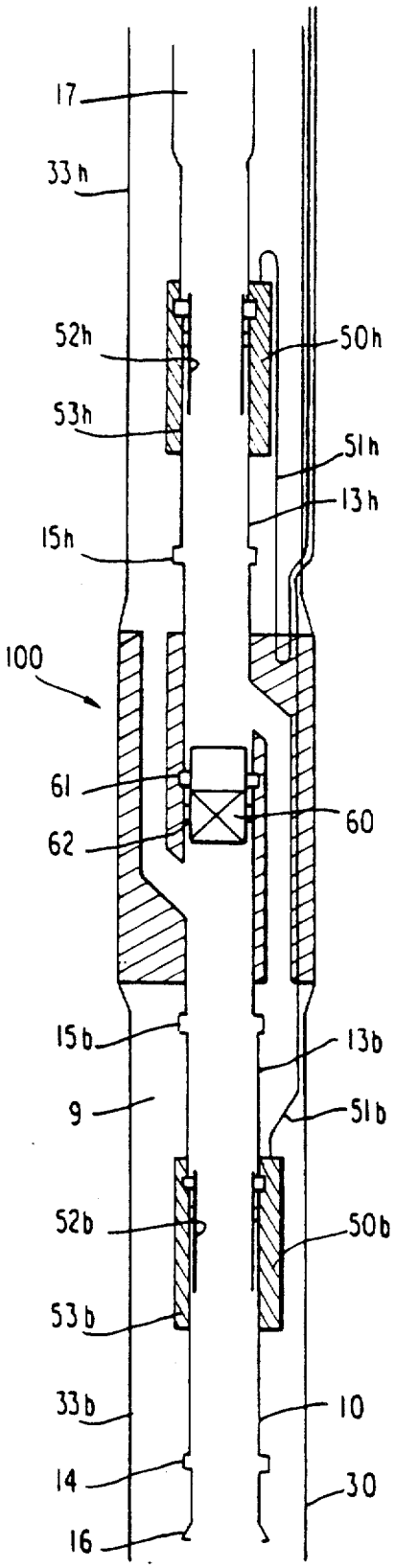
FIGS. 7 and 8 are axial sections through two advantageous embodiments of a safety system of the present invention.

FIG. 7 places the above-described sleeve 100 in the context of the protective tube 30 and the central tube 10 in which it is connected. However the tubes are shown highly diagrammatically. In particular the details of the threaded couplings and the interfitting are not shown. Similarly the couplings between the various lengths of tube are not shown. The person skilled in the art will nevertheless be aware that they are present without being reminded further. It should be understood that FIG. 7 shows a preferred safety system of the present invention which relates in particular to a special length 13 of the central tube 10 and a special length 33 of the protective tube 30 which engage the sleeve for the purpose of ensuring borehole safety.

The length 13 is constituted, in fact, by two substantially similar portions **13*b* and 13*h* which are fitted to opposite ends of the sleeve 100. Going away from the sleeve, each of these two portions identically comprises: a plug seat 15; and then a safety valve 50. In FIG. 7, reference numerals followed by the letter "b" (for bottom) designate items on the portion 13*b* comparable to items on the portion 13*h* designated by references followed by the letter "h" (for high). Although the seats 15 for the plug are not absolutely necessary, the valves 50 are advantageously valves of the normally-closed removable type: i.e. when no hydraulic oil arrives via control lines 51, the valve members 52 of the valves 50 close, thereby cutting off the flow inside the central tube 10. In the example shown, the valves have their valve bodies 53 disposed around the outside of the central tube 10 and are easily used while leaving an unobstructed flow passage inside the tube 10 (advantageous for lowering and raising various tools). There is no need for the valves 50 to be particularly compact. Where appropriate they may be installed by cable in conventional manner around the portion 13 of the tube 10. However, it is better to design the safety system as comprising the sleeve 100, the portions 13 of the central tube 10, and the portions 33 of the protective tube 30**, as a unit which is assembled on the surface and is then lowered into the borehole or is removed therefrom as a single entity.

The free ends of the two portions **13*b* and 13*h* are preferably of different diameters, with the top portion 13*h* terminating, for example, with a slight flare 17 while the bottom portion 13*b* does not change in size. The bottom portion may optionally be provided with a terminal annular groove 16. As a result, the length 13 is suitable for mounting within the central tube 10 while nevertheless making disassembly easy whichever portion of the tube 10 needs to be withdrawn. The details of the corresponding couplings are described below with reference to FIG. 8. In FIG. 7, it can be seen that another plug seat 14 is provided a little above the bottom end of the portion 13*b*. This seat 14 and the above-mentioned seats 15** are disposed in such a manner that once the corresponding plugs have been installed, then the tube sections are isolated from one another. Fluidtightness and mechanical strength can then be tested in each of the sections separately using various different tests familiar to the person skilled in the art.

Finally, it should be observed that in the structure of the present safety system, the length 33 of the associated protective tube 30 likewise comprises a top portion **33*h* and a bottom portion 33*b* with the present sleeve 100 being inserted therebetween. The lengths of the portions 33 may be comparable to the lengths of the portions 13 respectively protected thereby. Their only special feature is to include orifices for passing the control lines 51 for the valves 50. Since such orifices must also be fluidtight, it is advantageous for the two lines 51*h* and 51*b* for respective ones of the two safety valves 50 to follow the same path. To this end, the line 51*h* for the top valve 50*h* is preferably diverted towards the sleeve 100. There is less danger of the lines 51 partially received in the sleeve 100 breaking because of too much displacement inside the annular space 9**.

Figure 1:
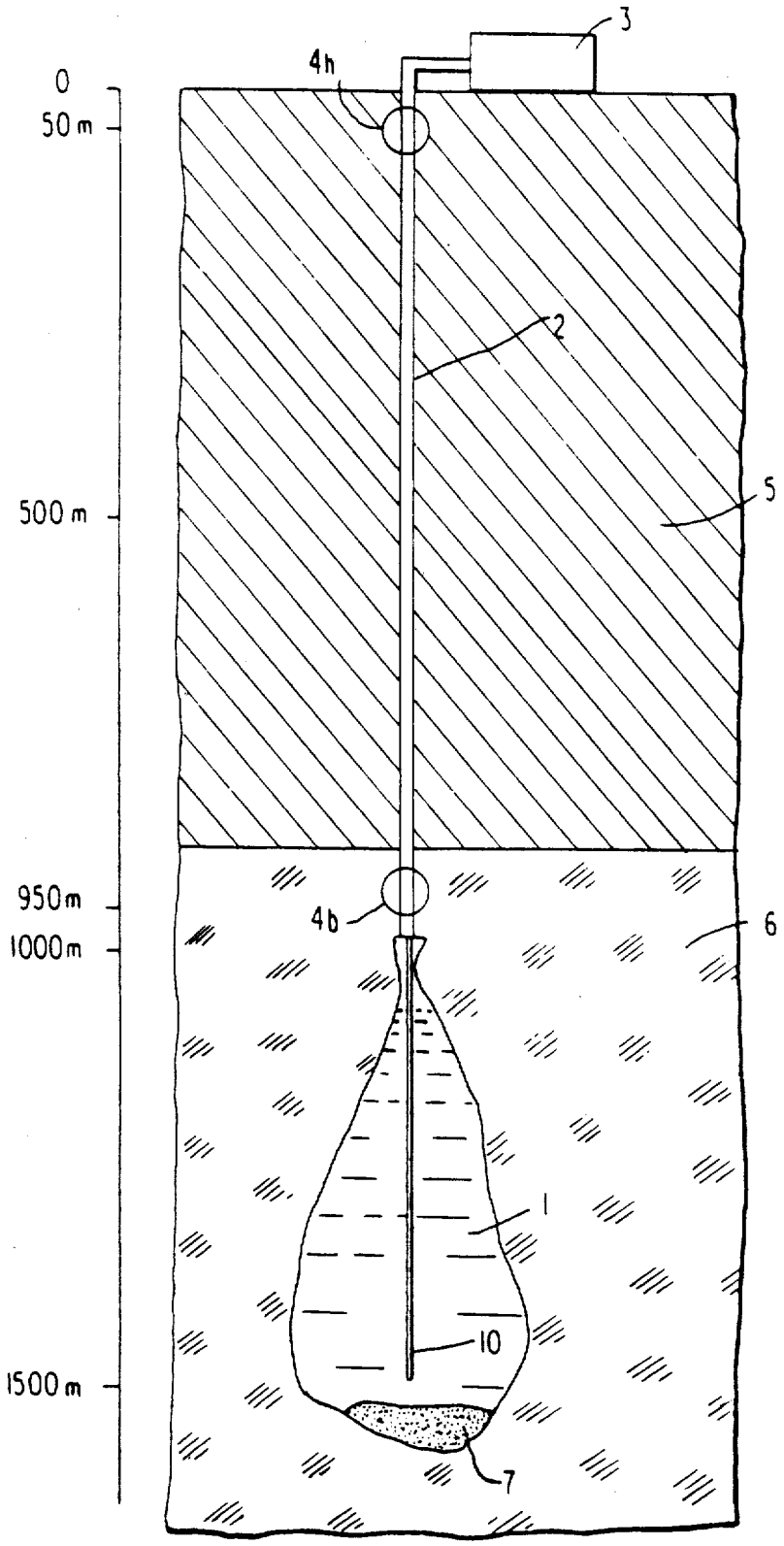
FIG. 1 is a highly diagrammatic vertical section through rock salt including a storage cavity washed out in the rock salt.
Figure 2:
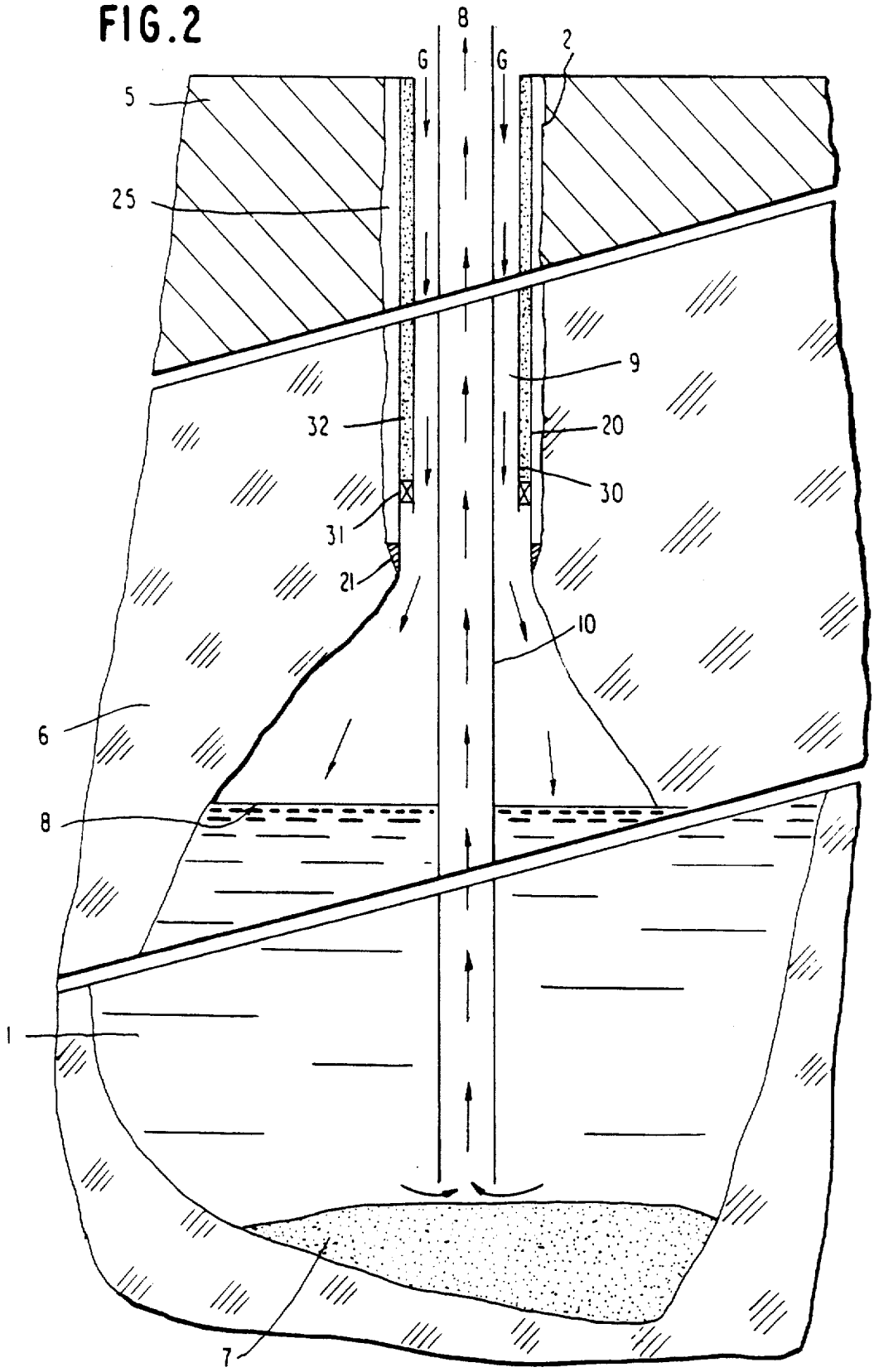
FIG. 2 is a section similar to FIG. 1, however it includes two pairs of nearly horizontal section lines with the rock between the lines of each pair being omitted so that a much larger scale can be used for other portions of the rock, with fluid motion during the dewatering stage being shown by arrows.

The total length of the safety system made up in this way may be of the order of a few tens of meters. A priori it is suitable for being placed down a borehole at any level between the surface and the shoe. However, two locations referenced **4*h* and 4*b* in FIG. 1** are the most advantageous. One of these locations is about 30 meters beneath the surface while the other one is about 10 meters above the shoe. The deeper one of these two positions is the more advantageous insofar as it puts the safety system out of the reach of numerous potential causes of damage to the borehole, e.g. earthquakes, surface explosions, or rearrangements of the terrain due to subsidence or other geological phenomena that take place over the long term.

Figure 8:
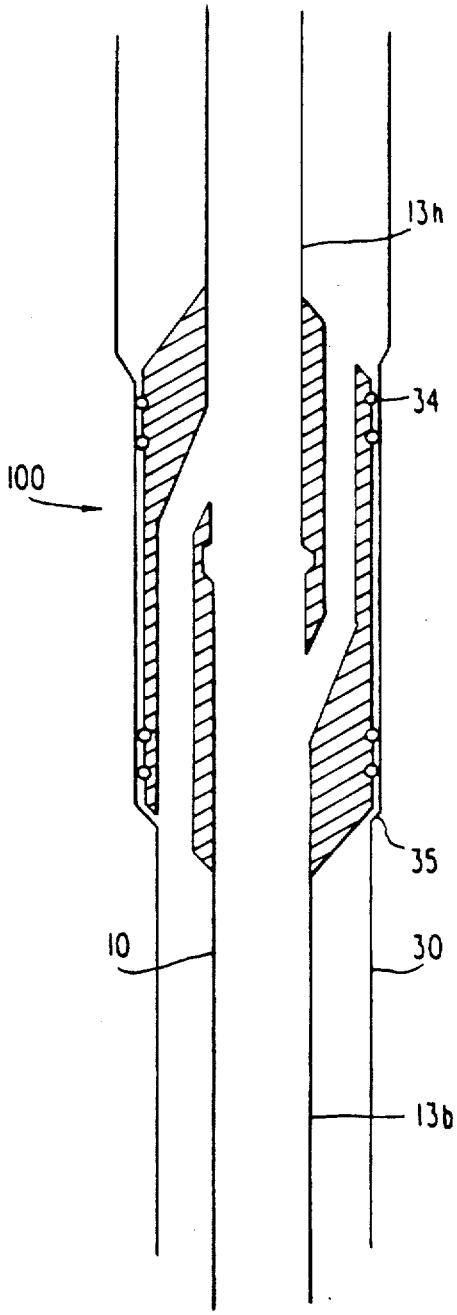

FIG. 8 shows another embodiment of the present safety system. This figure shows the sleeve 100 together with the portions **13*b* and 13*h* of the central tube disposed in line with the inside surface of the sleeve. If necessary, the sleeve 100 and the portions 13 are integrally formed for this purpose. This variant is of particular interest with respect to the outside surface of the sleeve. Instead of the portions 33 of the protection tube 30 extending the sleeve, there are now sealing O-rings 34. In FIG. 8, there are two such rings at each end of the sleeve 100. They provide sealing relative to the protective tube 30** in which the safety system made in this way is engaged.

A safety system is thus obtained which is even easier to install. Providing the protective tube 30 includes a suitable inside shoulder 35, the safety system is borehole supported by a thrust surface. Above the safety system, it is advantageous for the protective tube 30 to be a looser fit around the outside surface of the sleeve so as to facilitate lowering the sleeve down to its final position.

Figure 9:
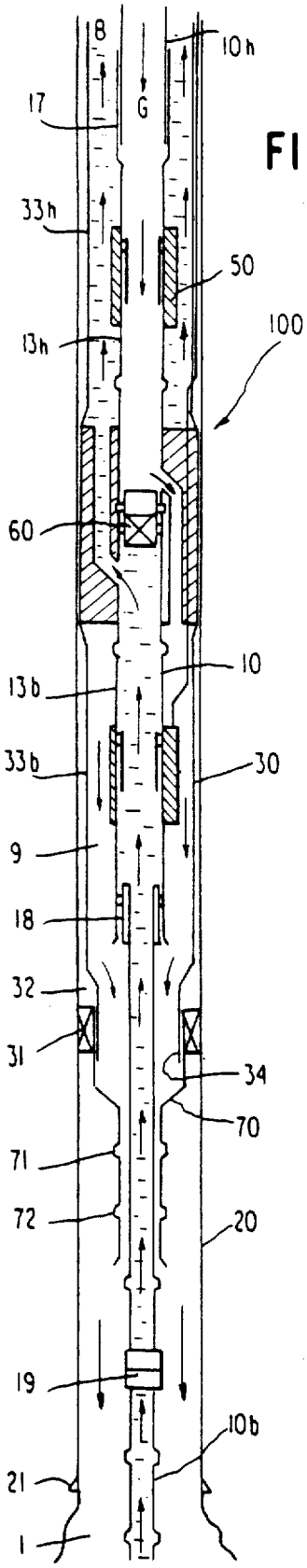
FIGS. 9 and 10 replace the safety system of FIG. 7 in the context of a borehole shown in axial section, these figures respectively showing the dewatering stage and the operating stage per se.
Figure 10:
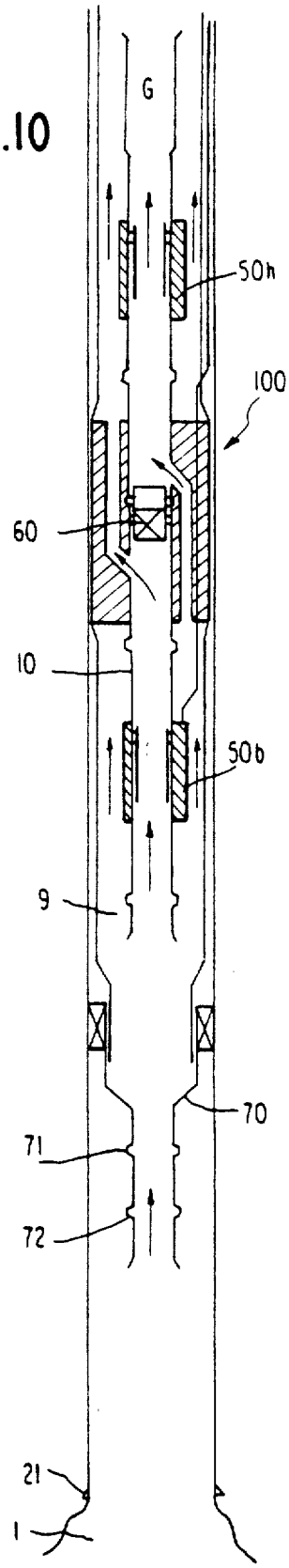

FIGS. 9 and 10 show how the above-described safety system is advantageously implemented in position **4*b* close to the shoe 21 at the bottom of the borehole. The system is easily recognized by its sleeve 100 having the central plug 60 installed therein with sealing being provided by stages of O-rings (cf. FIG. 7), with the portions 30*h* to 30*b* of the central tube 10 receiving the safety valves 50 and with the portions 33*h* to 33*b* of the protective tube 30. The top portion 33*h* of the protective tube 30 may continue right up to the surface, while its bottom portion 33*b* is adapted to terminate at a narrowing 34 suitable for engaging an inside annular packer 70. Sealing is guaranteed at the coupling by various stages of O-rings disposed between the narrowed portion 30 and the packer 70. The packer is conventionally provided inside the casing 20 of the borehole at a short distance above the borehole shoe 21. It comprises a top length of tube of larger diameter which is fixed in fluidtight manner to the casing 20 by means of an annular packer 31 for retaining the completion liquid 32. There follows a converging portion continued by a guide that is slightly narrower than the central tube 10 and that includes two plug seats 71 and 72. These serve to receive plugs so that the fluidtightness and the mechanical strength of the protective tube 30 can be tested and also so that the bottom of the borehole can be isolated from the cavity 1**, is so required.

In addition to the items described above and shown on their own in the configuration of FIG. 10, FIG. 9 also shows the top and bottom lengths **10*h* and 10*b* of the central tube 10 sandwiching the lengths 13 of tube 10 that constitutes a part of the safety system. The top lengths 10*h* engage in the terminal flare 17 of the top portion 13*h*. the corresponding coupling includes, for example, O-rings to ensure that the coupling is fluidtight. The bottom lengths 10*b* engage in the rectilinear portion of the bottom portion 13*b* and are fixed thereto by means of anchor pieces. An inflatable chamber 18 or other O-rings interposed between the overlying tubes may be provided to ensure perfect fluidtightness in spite of the relatively large difference in diameters. Such a difference is advantageous since once the chamber 18 has been deflated, the operator can raise one or more of the bottom lengths 10*b* through the length 13 of the central tube 10 (naturally after the plug 60** has been removed).

A safety seal 19 is preferably situated on the central tube 10 beneath the packer 70. Its function is to make it possible to let the remainder of the central tube 10 drop into the cavity 1, which portion extends all the way down to the bottom of the cavity, at least during the dewatering stage. This bottom portion may be dropped off either under control from the surface or under automatic control, e.g. in the event of the tube being subjected to excessive forces (due to falling rocks, etc.). Thus, the system of tubes shown in FIG. 9 and representative of the configuration used during dewatering gives rise to the flows represented by continuous arrows for the brine B and by dashed line arrows for the gas G. It can immediately be seen that the brine B is diverted at the sleeve 100 from the central tube 10 to the annular space 9, and that conversely the gas G is diverted from the central tube 10 to the annular space 9 but in the opposite flow direction to the brine.

In the operating stage as shown in FIG. 10, it is possible to remove the top and bottom lengths **10*h* and 10*b* of the central tube 10. The gas escapes beyond the annular packer 70 both via the central tube 10 and via the annular space 9. After passing through the sleeve 100, evacuation continues both via the tube 10 and via the annular space 9. In addition, should an accident cause the valves 50 to close, then all communication between the inside of the storage facility and the surface is interrupted. The bottom valve 50*b* interrupts flow inside the central tube 10 beneath the sleeve, i.e. it interrupts flow in the annular space 9 above the sleeve. Similarly, the top valve 50*h* interrupts the flow within the central tube 10** above the sleeve so that no gas flow can occur above the top valve.

Another way of implementing the present safety system during the operating stage consists, for example, initially in withdrawing the top safety valve **50*h*. Similarly, the plug 60 is removed. Thereafter, a liner for lining the bore 110 in the sleeve 100 is lowered so as to be applied over the openings of the sloping portions 113 of the ducts 131. So long as the liner is applied thereagainst sufficiently fluidtightly, all communication between the central tube 10 and the annular space 9 is thus prevented. All of the gas G flows finally along the tube 10 to the surface. The bottom valve 50*b*** that is left in place in the safety system is then capable of interrupting this flow in the event of an accident.

Figure 3:
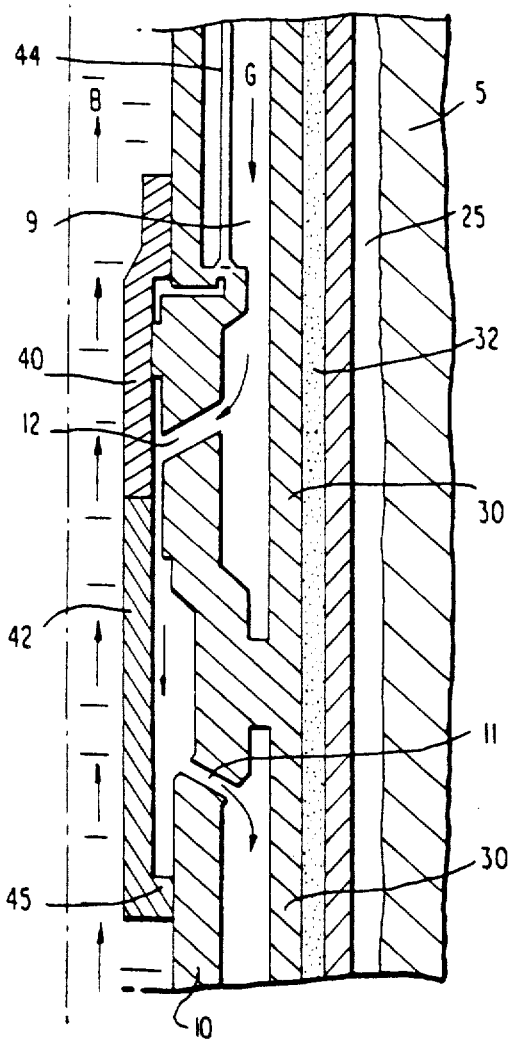
FIGS. 3 and 4 are axial half-sections through a borehole and the tubes constituting a prior art safety system, which system is shown in its deployed dewatering stage configuration in FIG. 3 and in its retracted configuration in FIG. 4 for the borehole operating stage per se.
Figure 4:
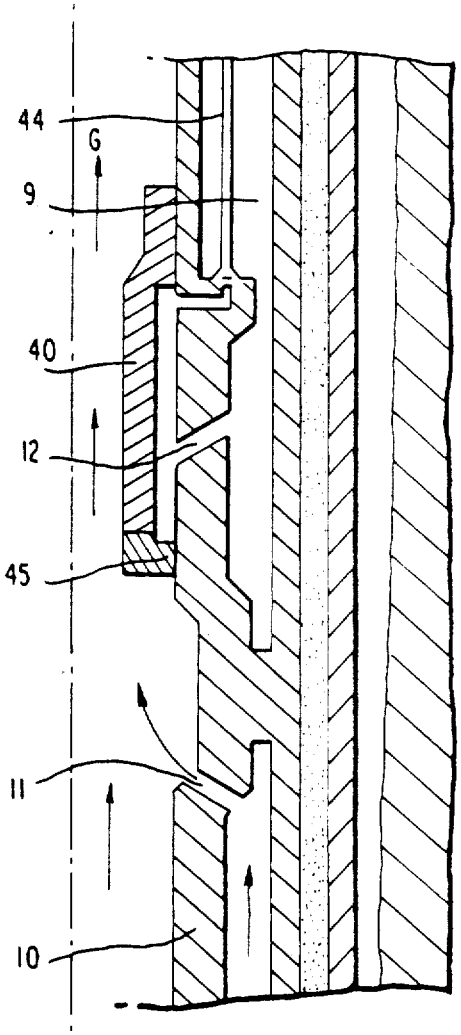

This method of using the present sleeve, which a priori comes close to the method of operating prior art safety devices as shown in FIGS. 3 and 4, nevertheless remains advantageous from the flow section point of view. The sole safety valve can be placed on the outside of the central tube thereby allowing the flow to be unhindered locally therein. In addition, the sleeve then used may have particularly thin walls. In other words, it is possible to reduce the section of the annular space in this case to a minimum. Any such reduction constitutes a gain for the central tube both with respect to flow rates achieved and with respect to passing various tools.

The person skilled in the art will doubtless find other implementations of the present method of operating a borehole, which method when expressed in general terms consists in enabling the central tube flow to intersect the annular space flow. In the above example, the cavity washed out in rock salt is intended to contain a supply of gas, with the intersection of two distinct fluid flows taking place during a dewatering stage, whereas in normal operation, the gas rises via the central tube and optionally via the annular space as borehole. However other applications may be envisaged such as boreholes for extracting from or for injecting into oil-bearing deposits. Although in this context the same fluid, hydrocarbon or water, may constitute in both of the intersecting flows, having each of the two flows occupying the central tube in turn makes it possible for them to be stopped by respective valves that operate only on the tube. It is also possible to force all of the fluid to pass via the central tube by closing the ducts in the sleeve and by removing its plug, in which case a single valve mounted on the central tube is sufficient. In any event, a larger flow section is offered to the fluid than is available in the prior art. This section can be further increased by omitting the protective tube 30 and by connecting the present sleeve 100 directly to the cemented casing 20. Thus, when the following claims refer to a peripheral tube, that designates equally the borehole, the protective tube, the association of the protective tube with cemented casing, or a production tube disposed around the central tube 10.

Figure 11:
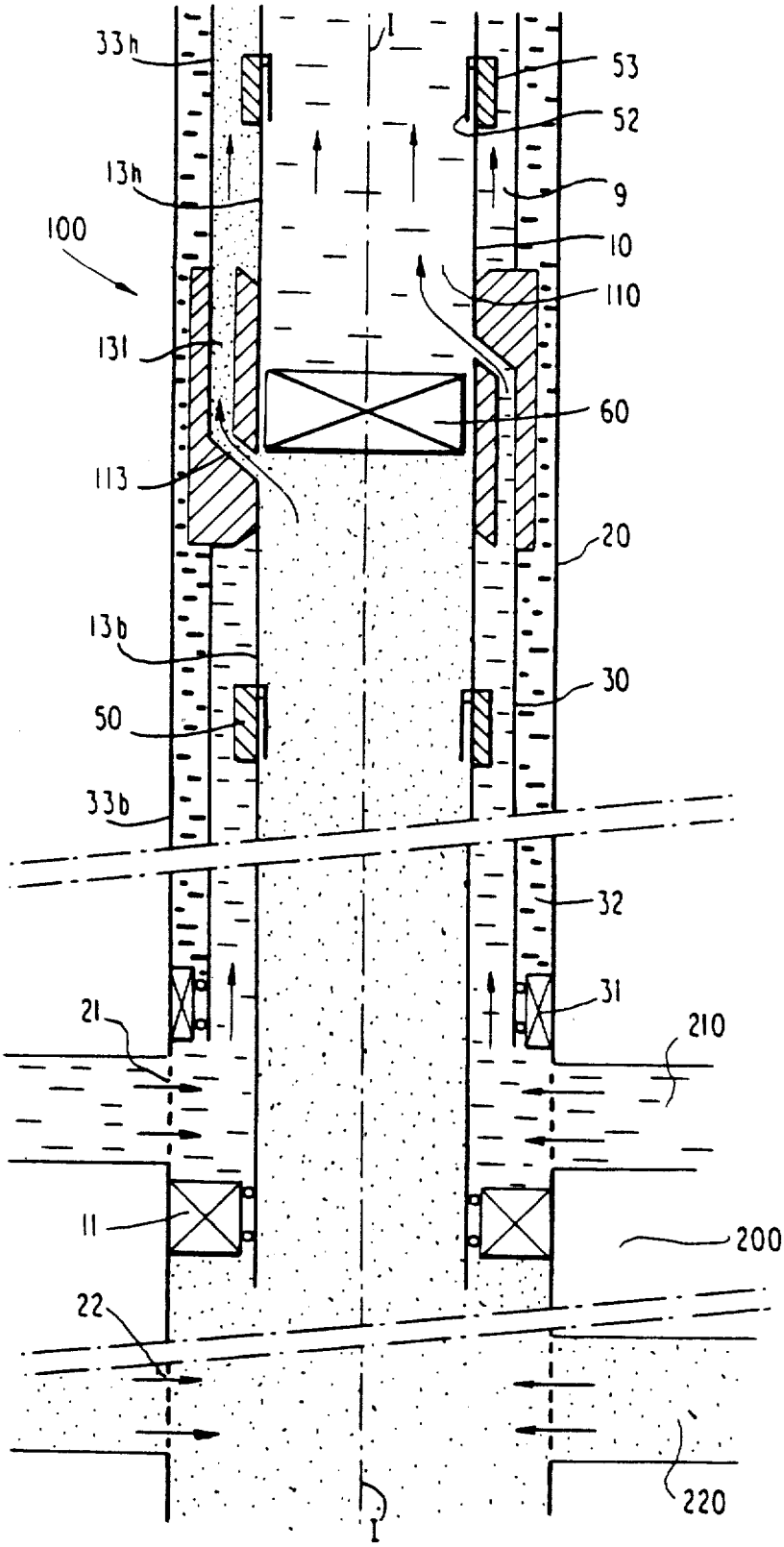
FIG. 11 is a diagrammatic axial section through a dual completion oil production well in which an embodiment of the present invention is implemented.

Finally, FIG. 11 is a theoretical diagram of another implementation of the present method. In this case a vertical axis I—I has been drawn to represent the axis of symmetry of an oil extraction well shown in longitudinal section. This well passes through a deposit including two hydrocarbon-rich layers 210 and 220 separated by an impermeable layer 200. In the drawing, these layers are represented by narrow horizontal strips. Even if they both contain the same hydrocarbons, the hydrocarbons are represented by distinct symbols in the figure: dashes for the hydrocarbons from the upper layer 210 and dots for the hydrocarbons from the lower layer 220. Two straight lines that slope slightly relative to the horizontal and that are situated between the two layers represent section lines to indicate that the vertical distance between the layers is arbitrary.

Thus, the fluid content of each of these two layers penetrates into the well. To this end, the casing 20 of the well may be provided, for example, with perforations 21 overlying the layer 210 (and 22 overlying the layer 220). It is also possible for there to be no casing at all in the bottom of the well. This applies in particular to wells in hard rock. In order to avoid contact between hydrocarbons from the two layers while they are being raised up the well, the present invention provides for disposing two concentric production tubes inside the well.

The inner tube, referred to below as the "central" tube 10, descends beyond the upper productive layer 210 down to the impermeable layer 200. Once a sufficient length of the bottom end of the tube overlies a portion of the casing 20 that has no perforations, then annular packer 11 may be interposed between the central tube 10 and the casing 20, thus effectively preventing hydrocarbons from the upper layer 210 penetrating into the central tube 10. Hydrocarbons from the lower layer 220 are, in contrast, free to penetrate therein (in particular under pressure existing inside the layer).

In the following paragraphs, the outer tube is referred to as the "peripheral"tube 30. The space 32 between the peripheral tube 30 and the casing 20 is often filled with a relatively dense liquid. The annular packer 31 disposed in the space 32 serves to retain this liquid. Its function is to off-load the casing by exerting a radial supporting force thereon. As shown in FIG. 11, the annular packer 31 is disposed in accordance with the invention above the upper perforations 21 through the casing 20. It then surrounds the bottom end of the peripheral tube 30 so that the hydrocarbons from the upper layer 210 rise (likewise under the effect of their own pressure) inside the peripheral tube. The presence at this depth of the longer central tube 10 obliges the hydrocarbons from the upper layer to flow solely via the annular space 9 between the two concentric tubes.

In the context of the invention, these tubes are further provided with a safety system as described above. Without repeating all of its structural details, its general structure is recalled. Thus there is a sleeve 100 in the form of a thick-walled cylinder that is several meters high. Its inside diameter is chosen to be suitable for connection to the central tube 10 so that the inside surface of the sleeve 100 forms together therewith a single central bore 110. However, in operation, this central bore 110 is closed by a plug 60 which is installed halfway up the sleeve 100 between its top and bottom ends.

The outside diameter of the sleeve 100 is chosen so that the peripheral tube 30 is connected thereto with the outside surface of the sleeve 100 constituting a continuous intermediate space 32 in association therewith. As a result the thickness of the sleeve 100 is substantially the same as the thickness of the annular space 9 between the two concentric tubes. This space is not closed by the sleeve since longitudinal ducts 131 are formed in the thickness of its wall.

A first series of these ducts runs from the top end of the sleeve 100 and after a bend 113 terminates at the inside surface thereof beneath the plug 60. A second series of these ducts runs conversely from the bottom end of the sleeve 100 to terminate similarly at its inside surface, but this time above the plug 60. In other words the flows respectively established in the central tube 10 and in the annular space 9 are thus crossed over.

The advantage of this crossover can be seen on examining the other components of the safety system. These are the portions **13*h* and 13*b* of the central tube 10 disposed respectively above and below the sleeve 100 and each of which has the body 53 of a safety valve 50 formed thereabout. With their valve members 52 inside the central tube 10, these valves may be of the regular normally-closed type and they may be removable and suitable for installation by cable, in particular. The portions 33*h* and 33*b* of the peripheral tube 30 are also installed around the portions 13. The safety system constituted in this way may be about 10 meters tall. It is inserted in the string of individual tubes lowered down the borehole to form the concentric production tubes. Thus, in the event of necessity (an accident or shutting down), the valves 50** may be closed to stop the flow of each of the two kinds of hydrocarbon.

However, by locating the valves outside the central tube 10, the central tube is left practically free of obstruction. In particular it remains possible to lower various downhole tools down the central tube since removing the plug 60 is not particularly difficult. In addition, as represented symbolically by the two pairs of lines sloping a little relative to the horizontal and beneath the safety system, the safety system may be disposed at any depth above the upper layer. Its location may thus be selected as a function of safety requirements (e.g. with respect to possible sabotage) or as a function of well activity (for operation that is intermittent to a greater or lesser extent, etc.).

In addition to these advantages together with others not mentioned herein that relate to the specific structure of the safety system, the above-described "dual completion" method has advantages that are more specific. Firstly, the flow sections for each of the two hydrocarbon flows are maximized. To be convinced of this, it suffices to observe that at the bottom of the production well, the entire inside section of the peripheral tube 30 contains a flow, with the hydrocarbons of the lower layer 220 passing along the central tube 10 while the hydrocarbons from the upper layer 210 pass along the annular space 9. From this point of view, it is recommended that the diameter of the peripheral tube 30 is selected to be as large as possible given the total available section in the cased borehole. Similarly, at the top of the borehole, although the two kinds of hydrocarbon are interchanged, their flows still occupy the full section. In between, the sleeve 100 does not constitute a significant reduction in the flow section given that the number of ducts 131 formed in its wall is large (e.g. 8 ducts in each of the series). Similarly, the valves 59 disposed around the central tube 10 constitute significant obstacles to the flows. As a result head losses in the rising hydrocarbons are minimized.

In addition, only simple packers are used for closing the angular space. These comprise the packer 31 closing off the supporting liquid 32 from the hydrocarbons of the upper layer, and the packer 11 isolating the two kinds of hydrocarbon. Dual packers are thus avoided, together with the extra expense that they involve.

It may be observed that these last two advantages come from using concentric production tubes. This remarkable disposition can nevertheless be envisaged in this case because of simultaneous use of the safety system of the present invention. If necessary, this safety system can stop hydrocarbons rising without degrading the two advantages in question to any extent.

It is clear that the present safety sleeve can be used to provide similar surfaces in installations other than boreholes. In particular, concentric ducts in chemical complexes may find it advantageous to use such a sleeve to cross over flows therein. That is why the following claims relate initially to the specific structure of the sleeve. Thereafter there are claims to its application to boreholes.

I claim:

1. A safety sleeve for a borehole communicating in particular with a underground reserve of fluid under pressure, a peripheral tube being disposed in said borehole together with a central tube coaxial with said peripheral tube, thereby defining an annular space between them, wherein the sleeve is constituted by a hollow cylinder having a top end and a bottom end and an inside surface and an outside surface, said sleeve being adapted to be connected level with said outside surface to said peripheral tube and level with said inside surface to said central tube, an annular groove being formed in said inside surface to receive a plug, and ducts being provided to put said annular space into communication with said central tube, a first series of said ducts running from said top end of said cylinder and terminating in said inside surface between said groove and said bottom end of said cylinder, while a second series of said ducts runs from said bottom end of said cylinder and terminates in said inside surface between said groove and said top end of said cylinder.

2. A safety sleeve according to claim 1, wherein said cylinder is a thick-walled cylinder and each of said ducts includes a portion extending longitudinally in said thick wall of said cylinder and extended by a bend and an oblique portion.

3. A safety sleeve according to claim 2, wherein said cylinder constituting said sleeve is machined in a billet of steel or is forged.

4. A safety sleeve according to claim 1, wherein each of said ducts is locally cylindrical in section, said ducts being preferably circumferentially distributed at uniform spacing.

5. A safety sleeve according to claim 1, wherein there are eight ducts in all, each of said series of ducts comprising four ducts that are immediately adjacent to one another.

6. A safety sleeve according to claim 1, wherein each of said series of ducts is constituted by the geometrical envelope of parallel cylindrical channels disposed in such a member that pairs of adjacent channels interpenetrate.

7. A safety sleeve according to claim 1, wherein said cylinder constituting said sleeve has a height lying in the range about 1.5 m to about 3 m.

8. A safety system comprising a sleeve according to claim 1 together with a length of central tube constituted by a top portion connected to said top end of said sleeve and by a bottom portion connected to said bottom end of said sleeve, at least said bottom portion being provided with a safety valve suitable for closing said central tube in the event of an accident.

9. A safety sleeve according to claim 8, wherein said length of central tube is of the order of 10 meters longs.

10. A safety sleeve according to claim 8, wherein a plug seat is provided in each of said portions of said length of central tube in the immediate proximity of said sleeve.

11. A safety sleeve according to claim 8, wherein said top portion of said length of central tube is terminated in a flare.

12. A safety sleeve according to claim 8, wherein said bottom portion of said length of central tube is terminated by an inside annular groove, with another plug seat being disposed between said safety valve and said groove.

13. A safety sleeve according to claim 8, wherein said safety valve is of the normally-closed removable type.

14. A safety sleeve according to claim 13, wherein said safety valve is installed around said length of central tube and includes a control line for conveying a hydraulic fluid, which line is held in place by virtue of being received in part within said sleeve.

15. A safety sleeve according to claim 8, wherein the outside surface of said sleeve is provided with ring seals for providing sealing between said sleeve and the peripheral tube.

16. A safety sleeve according to claim 8, including a length of peripheral tube which is substantially as long as said length of central tube and which is similarly constituted by a top portion connected to said top end of said sleeve and by a bottom portion connected to said bottom end of said sleeve.

17. A safety sleeve according to claim 16, wherein said peripheral tube is a protective tube installed within cemented casing, and wherein said safety valve is installed around said length of central tube and includes a control line for conveying a hydraulic fluid, which line is held in place by virtue of being received in part within said sleeve, and wherein said top portion of said length of peripheral tube includes an orifice for passing said control line, means being provided to seal said orifice.

18. A method of implementing a safety system according to claim 8 comprising the step of operating a borehole in communication in particular with an underground reserve of fluid under pressure, a peripheral tube being disposed in said borehole together with a central tube coaxial with said peripheral tube such that an annular space is defined between them, and such that flows established respectively in the central tube and in the annular space are interchanged.

19. A method according to claim 18, wherein a first operation of said method consists in connecting said safety system to said central and peripheral tubes, said top portion of said length of the central tube being likewise provided with a further safety valve suitable for closing said central tube in the event of an accident.

20. A method according to claim 19, applicable to said underground reservoir being constituted by a cavity washed out from rock salt, which cavity is initially filled with brine, and applicable to said fluid in the reserve being a gas, wherein an intermediate operation of said method consists in filling said cavity with said gas, said gas being injected under pressure via said central tube above said sleeve, and then passing through said annular space beneath said sleeve, thereby pushing said brine which rises via said central tube beneath said sleeve and is recovered from said annular space above said sleeve.

21. A method according to claim 19, wherein a final operation of said method consists in removing said fluid in the reserve to the surface and/or injecting said fluid into said underground reserve via both said central tube and said annular space.

22. A method according to claim 19, applicable to said reserve including an upper hydrocarbon producing layer and a lower hydrocarbon producing layer in such a manner as to enable the hydrocarbons in both of the layers to penetrate into the borehole, wherein the method consists in:

a) during the first operation of said method, placing in the borehole:

the peripheral tube in such a manner that a bottom end thereof lies above the upper producing layer, a first annular packer being disposed around the bottom end of the peripheral tube to block the space between the peripheral tube and the wall of the borehole; and the central tube inside the peripheral tube in such a manner that a bottom end of the central tube lies between the upper producing layer and the lower producing layer, a second annular packer being disposed around the bottom end of the central tube to block the space between the central tube and the wall of the borehole; and b) during subsequent "dual completion" operation, establishing the following flows:

at the bottom of the borehole, a flow of hydrocarbons from the lower producing layer in the central tube, and a flow of hydrocarbons from the upper producing layer in the annular space;

at the top of the borehole, the flow of hydrocarbons from the upper producing layer in the central tube, and the flow of hydrocarbons from the lower producing layer in the annular space;

the hydrocarbon flows from the two layers intersecting in the sleeve.

23. A method according to claim 22, wherein the space between the peripheral tube and the wall of the borehole is selected to be as narrow as possible compatible with the operations of installing the peripheral tube.

24. A method according to claim 22, wherein the safety valves have bodies installed around the central tube to which they ar e attached.

25. A method according to claim 22, wherein the wall of the borehole is lined with casing which is provided with perforations where it overlies the hydrocarbon producing layers.

26. A method according to claim 25, wherein a supporting liquid is retained by the first annular packer which liquid is disposed between the peripheral tube and the casing.

27. A method according to claim 18, wherein a first operation of said method consists of connecting said safety system to said central peripheral tubes with a liner being applied in sealed manner against the inside surface of said sleeve in such a manner as to close said ducts, said plug being removed, with a subsequent operation of said method consisting in drawing off said fluid from the underground reserve and/or in injecting fluid into said reserve via said central tube only.

28. A method according to claim 19, wherein during the operation of connecting said safety system, said safety system is disposed at least 30 meters beneath the surface of the ground.

29. A method according to claim 19, said borehole further including cemented casing terminated at the bottom end by a shoe, and said peripheral tube being constituted by a protective tube installed inside said cemented casing, wherein during the operation of connecting said safety system, said system is disposed inside said borehole about 10 meters above said shoe.

30. A method according to claim 19, wherein during the operation of connecting said safety system, top lengths of the central tube are provided with sealing rings and engaged within said top portion of said length of central tube of said safety system, whereas bottom lengths of the central tube are attached within said bottom portion of the length of the central tube of said safety system via anchor pieces and an inflatable chamber such that said top and bottom lengths may be withdrawn at any time without it being necessary to dismantle said connection to said safety system.

* * * * *